US011390476B2

(12) United States Patent
Suzuki et al.

(10) Patent No.: US 11,390,476 B2
(45) Date of Patent: Jul. 19, 2022

(54) SHEET FEEDING APPARATUS AND IMAGE FORMING APPARATUS

(71) Applicant: CANON KABUSHIKI KAISHA, Tokyo (JP)

(72) Inventors: Masato Suzuki, Mishima (JP); Akira Matsushima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 386 days.

(21) Appl. No.: 16/703,967

(22) Filed: Dec. 5, 2019

(65) Prior Publication Data

US 2020/0189866 A1 Jun. 18, 2020

(30) Foreign Application Priority Data

Dec. 12, 2018 (JP) ..... JP2018-232988

(51) Int. Cl.

| | |
|---|---|
| ***B65H 3/44*** | (2006.01) |
| ***B65H 1/26*** | (2006.01) |
| ***G03G 15/00*** | (2006.01) |
| ***B65H 5/36*** | (2006.01) |

(52) U.S. Cl.

CPC ..... *B65H 3/44* (2013.01); *B65H 1/266* (2013.01); *B65H 5/36* (2013.01); *G03G 15/6529* (2013.01); *B65H 2601/11* (2013.01)

(58) Field of Classification Search

CPC . B65H 5/36; B65H 3/44; B65H 1/266; B65H 2601/11; G03G 15/6529

See application file for complete search history.

(56) References Cited

U.S. PATENT DOCUMENTS

| | | | | |
|---|---|---|---|---|
| 5,988,622 | A * | 11/1999 | Shigeta | G03G 15/6502 271/9.12 |
| 6,695,303 | B2 * | 2/2004 | Okada | B65H 5/062 271/9.12 |
| 9,290,340 | B2 * | 3/2016 | Yamamoto | B65H 5/38 |
| 9,302,864 | B2 * | 4/2016 | Yamaguchi | B65H 1/14 |
| 9,758,325 | B2 * | 9/2017 | Takeuchi | B65H 7/20 |
| 9,840,382 | B2 | 12/2017 | Okazaki et al. | |

(Continued)

FOREIGN PATENT DOCUMENTS

| | | |
|---|---|---|
| JP | H10-212049 A | 8/1998 |
| JP | 2000-335777 A | 12/2000 |

(Continued)

*Primary Examiner* — Patrick Cicchino

(74) *Attorney, Agent, or Firm* — Venable LLP

(57) ABSTRACT

A sheet feeding apparatus includes an apparatus body, a drawer portion including a first contact portion, a feeding portion, and a pivot member configured to pivot between a first position and a second position, the pivot member constituting a part of a conveyance path at the first position, wherein the pivot member does not overlap a moving path of the drawer portion in a case where the pivot member is located at the first position, and overlaps the moving path in a case where the pivot member is located at the second position. The pivot member includes a second contact portion that pivots the pivot member from the second position toward the first position while being in sliding contact with the first contact portion in a case where the pivot member is located at the second position and the drawer portion is being inserted into the apparatus body.

19 Claims, 12 Drawing Sheets

(56) References Cited

U.S. PATENT DOCUMENTS

| | | | |
|---|---|---|---|
| 10,183,820 | B2 | 1/2019 | Yoshida et al. |
| 10,233,041 | B2 | 3/2019 | Okazaki et al. |
| 2019/0077621 | A1 | 3/2019 | Kato et al. |

FOREIGN PATENT DOCUMENTS

| | | | |
|---|---|---|---|
| JP | 2006-069732 | A | 3/2006 |
| JP | 2008-058892 | A | 3/2008 |
| JP | 2013-029783 | A | 2/2013 |
| JP | 2017-081738 | A | 5/2017 |

* cited by examiner

SHEET FEEDING APPARATUS AND IMAGE FORMING APPARATUS

BACKGROUND OF THE INVENTION

Field of the Invention

The present invention relates to a sheet feeding apparatus that feeds a sheet and an image forming apparatus including the sheet feeding apparatus.

Description of the Related Art

In the related art, according to Japanese Laid-open Patent Publication No. 2000-335777, there has been proposed a sheet supplying apparatus which is connected to a lower portion of a laser beam printer and in which two storages for storing sheets are arranged side by side. The sheet fed from the storage on the left side passes through a conveyance path formed by an upper guide and a lower guide disposed above the storage on the right side, and is sent to the laser beam printer. The upper guide is fixed to a frame of the sheet supplying apparatus and the lower guide is supported so as to be lowered by a guide formed in the frame on the far side of the apparatus and a link provided on the near side of the apparatus.

The lower guide forms the conveyance path by engaging with a positioning shaft provided on the upper guide, and is lowered while being supported by the link by the weight of the lower guide by operating a lever provided on the lower guide. When the lower guide is lowered, the conveyance path can be opened and thus a sheet jammed in the conveyance path can be removed.

The lower guide described in Japanese Laid-open Patent Publication No. 2000-335777 is configured not to interfere with the storage on the right side even in a state where the lower guide is lowered. By the way, when the lower guide is configured to be more widely opened downward in order to improve a jam handling capability without increasing the size of the sheet supplying apparatus, the lower guide and the storage may interfere with each other. For example, when the storage is to be mounted in a state where the lower guide is open, since the lower guide and storage may collide and break, it is necessary to mount the storage after closing the lower guide, which leads to complication of the operation.

SUMMARY OF THE INVENTION

According to one aspect of the present invention, a sheet feeding apparatus includes an apparatus body including a conveyance path through which a sheet passes, a drawer portion provided to be mounted on and drawn out from the apparatus body and configured to support the sheet, the drawer portion including a first contact portion, a feeding portion configured to feed the sheet supported on the drawer portion, and a pivot member configured to pivot between a first position and a second position located below the first position around a pivot shaft extending in an axial direction parallel to a mounting direction of the drawer portion, the pivot member constituting a part of the conveyance path at the first position, wherein the pivot member does not overlap a moving path of the drawer portion in a case where the pivot member is located at the first position, and overlaps the moving path in a case where the pivot member is located at the second position, and the pivot member includes a second contact portion that pivots the pivot member from the second position toward the first position while being in sliding contact with the first contact portion in a case where the pivot member is located at the second position and the drawer portion is being inserted into the apparatus body.

Further features of the present invention will become apparent from the following description of exemplary embodiments with reference to the attached drawings.

DESCRIPTION OF THE EMBODIMENTS

First Embodiment

Figure 1:
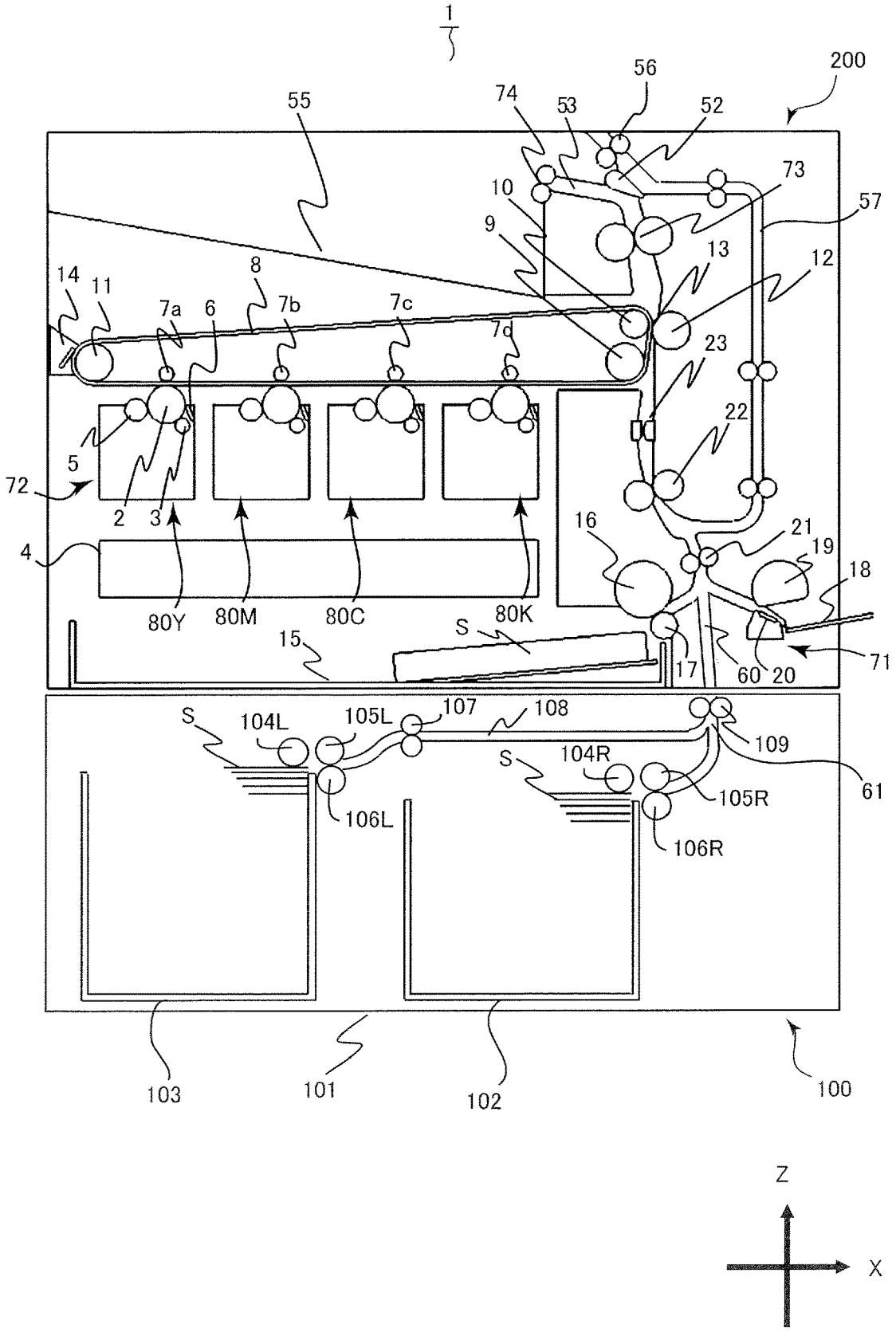
FIG. 1 is an overall schematic diagram showing a printer according to a first embodiment.

A first embodiment will be described below with reference to the drawings. It is noted that, in the following description, it is assumed that a positional relationship between the top, bottom, right, left, front, and deep sides is represented with reference to the state where an image forming apparatus is viewed from the front (viewpoint in FIG. 1). The right-left direction of the image forming apparatus is defined as an X direction, the front-rear direction is defined as a Y direction, and the vertical direction is defined as a Z direction. For example, as the right direction is represented as a "+X direction", the side indicated by the arrow indicating the direction in the drawing is represented as "+" and the opposite side is represented as "−".

Overall Configuration

First, the first embodiment will be described. A printer 1 serving as an image forming apparatus is an electrophotographic laser beam printer. As shown in FIG. 1, the printer 1 includes a printer body 200 and a sheet feeding apparatus 100 connected to a lower portion of the printer body 200 and on which a sheet is loaded. The sheet feeding apparatus 100 is provided as an option, and the printer body 200 can be used alone.

The printer body 200 includes a main body feeding portion 71 that feeds sheets S, an image forming portion 72 that forms images on the sheets S, a fixing portion 73 that fixes the images on the sheets S, and a discharge roller pair 74. A discharge tray 55 on which the sheets S discharged by the discharge roller pair 74 are loaded is provided on an upper portion of the printer body 200.

The image forming portion 72 serving as an image forming portion includes a laser scanner 4, four process cartridges 80Y, 80M, 80C, and 80K, and intermediate transfer belt 8, and is a so called four-drum full-color image forming portion. The process cartridges 80Y, 80M, 80C, and 80K form toner images of yellow (Y), magenta (M), cyan (C), and black (K) colors, respectively, and have the same configuration except for the colors of the toner images. Therefore, only the configuration of the process cartridge 80Y will be described, and descriptions of the other process cartridges 80M, 80C, and 80K will not be repeated.

The process cartridge 80Y has a photoconductive drum 2, a charge roller 3, a development roller 5, and a cleaning blade 6. The intermediate transfer belt 8 is wound around a drive roller 9, a secondary transfer counter roller 10, and a tension roller 11, and is disposed above the four process cartridges 80Y, 80M, 80C, and 80K. The intermediate transfer belt 8 is disposed so as to be in contact with the photoconductive drums of the process cartridges 80Y, 80M, 80C, and 80K, and is driven to rotate counterclockwise by the drive roller 9. In addition, four primary transfer rollers 7*a*, 7*b*, 7*c*, and 7*d* that are in contact with an inner peripheral surface of the intermediate transfer belt 8 at positions facing the respective photoconductive drums are provided inside the intermediate transfer belt 8, and a cleaning unit 14 is provided outside the intermediate transfer belt 8. The image forming portion 72 includes a secondary transfer roller 12 that is in contact with an outer peripheral surface of the intermediate transfer belt 8 at a position facing the secondary transfer counter roller 10.

The main body feeding portion 71 has a cassette 15 on which the sheets S are loaded, a feed roller 16 that feeds the sheets S loaded on the cassette 15, and a separating roller 17 that forms a nip together with the feed roller 16 and that separates the sheets one by one. The main body feeding portion 71 has a manual sheet-feeding tray 18 into which the sheets are manually fed, a feed roller 19 that feeds the sheets loaded by the manual sheet-feeding tray 18, and a separating pad 20 that forms a nip together with the feed roller 19 and that separates sheets one by one. The main body feeding portion 71 feeds the sheets from either the cassette 15 or the manual sheet-feeding tray 18.

Figure 2:
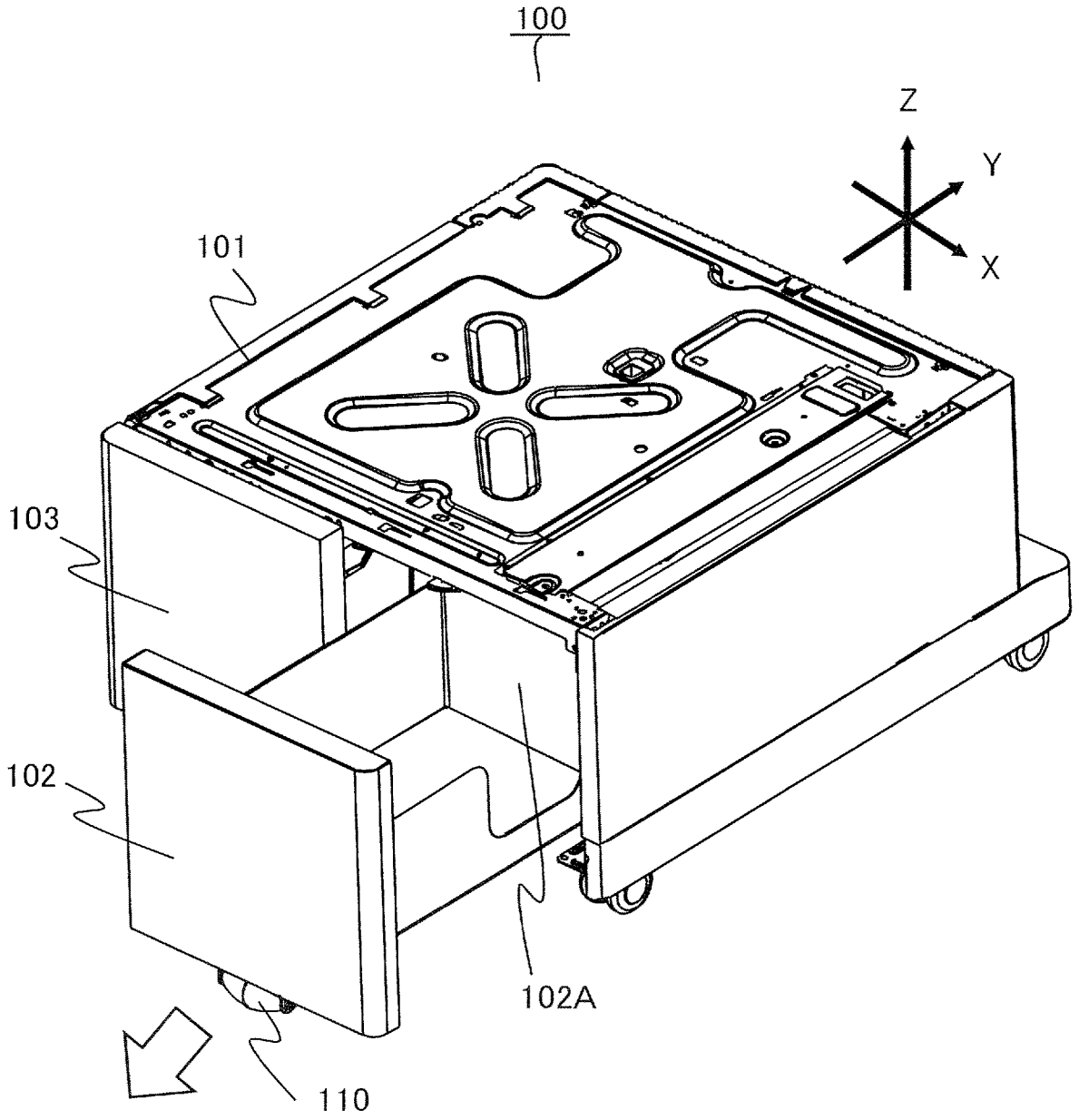
FIG. 2 is a perspective view showing a sheet feeding apparatus.

The sheet feeding apparatus 100 includes a left tray 103 and a right tray 102 of a right and left two-stage deck type that can load sheets up to a letter horizontal size or A4 horizontal size. As shown in FIGS. 1 and 2, the left tray 103 and the right tray 102 that are adjacent to each other in the right-left direction are provided so as to be mounted on and drawn out from a casing 101 of the sheet feeding apparatus 100.

In the present embodiment, an insertion direction of the left tray 103 and the right tray 102 is the +Y direction, and a drawing-out direction is the −Y direction. The left tray 103 and the right tray 102 each have a tray roller 110 that can roll on an installation surface, and are stably supported on the installation surface even when the left tray 103 and the right tray 102 are drawn out from the casing 101.

As shown in FIG. 1, the sheet feeding apparatus 100 includes a pickup roller 104L that feeds the sheets S supported by the left tray 103, and a feed roller 105L and a separating roller 106L that separate the fed sheets S one by one. Similarly, the sheet feeding apparatus 100 includes a pickup roller 104R serving as a feeding portion that feeds the sheets S supported by the right tray 102, and a feed roller 105R and a separating roller 106R that separate the fed sheets S one by one. The pickup rollers 104L and 104R, the feed rollers 105L and 105R, and the separating rollers 106L and 106R are supported by the casing 101 via a holder and a shaft (not illustrated).

The sheet S fed from the left tray 103 serving as a second drawer portion is conveyed along a conveyance path 108 by a conveyance roller pair 107. The sheet S fed from the right tray 102 merges with the conveyance path 108 at a merge portion 61 and is conveyed to the printer body 200 by a conveyance roller pair 109. The sheet S sent from the sheet feeding apparatus 100 to the printer body 200 is conveyed upward through an optional conveyance path 60.

Next, an image forming operation of the printer 1 configured as described above will be described. When image data transmitted from a personal computer (not illustrated) or the like is input to the laser scanner 4, a laser beam corresponding to the image data is emitted from the laser scanner 4 onto the photoconductive drum 2 of the process cartridge 80Y.

In this case, the surface of the photoconductive drum 2 is uniformly charged to a predetermined polarity and potential in advance by the charge roller 3, and an electrostatic latent image is formed on the surface of the photoconductive drum 2 by the laser beam emitted from the laser scanner 4. The electrostatic latent image formed on the photoconductive drum 2 is developed by the development roller 5, and a yellow (Y) toner image is formed on the photoconductive drum 2.

Similarly, the photoconductive drums of the process cartridges 80M, 80C, and 80K are irradiated with laser beams emitted from the laser scanner 4, and magenta (M), cyan (C), and black (K) toner images are formed on the respective photoconductive drums. The toner images of the respective colors formed on the respective photoconductive drums are transferred to the intermediate transfer belt 8 by the primary transfer rollers 7*a*, 7*b*, 7*c*, and 7*d*, and are conveyed to the secondary transfer roller 12 by the intermediate transfer belt 8 rotated by the drive roller 9. An image forming process for each color is performed at the timing of superimposing on the upstream toner image that has been primarily transferred onto the intermediate transfer belt 8. The toner remaining on the photoconductive drum 2 is collected by the cleaning blade 6.

In parallel with the image forming process, the sheet S is fed from the cassette 15 or the manual sheet-feeding tray 18 of the printer body 200 and the left tray 103 or the right tray 102 of the sheet feeding apparatus 100. The fed sheet S is conveyed toward a registration roller pair 22 by a conveyance roller pair 21. The sheet S hits a nip of the registration roller pair 22 in a non-rotated state, such that a loop is formed and skewing is corrected.

The registration roller pair 22 is driven in synchronization with the image formation timing, and the sheet S is conveyed to a transfer nip 13 formed by the secondary transfer roller 12 and the secondary transfer counter roller 10. A full color toner image on the intermediate transfer belt 8 is transferred to the sheet S conveyed to the transfer nip 13 by a secondary transfer bias applied to the secondary transfer roller 12. The sheet S to which the toner image is transferred is applied with predetermined heat and pressure by the fixing portion 73, and the toner image is fixed by melting and fixing the toner. The sheet S that has passed through the fixing portion 73 is discharged to the discharge tray 55 by the discharge roller pair 74. A sheet sensor 23 is disposed between the registration roller pair 22 and the transfer nip 13, and the sheet sensor 23 detects the position of the sheet to be conveyed.

When images are formed on two sides of the sheet S, the sheet S on which an image is formed on a first surface and passes through the fixing portion 73 is guided to a reverse roller pair 56 by a guide member 52. When a trailing end of the sheet S passes through the guide member 52, the reverse roller pair 56 is reversed and the sheet S is switched back. The sheet S is guided to a duplex conveyance path 57 by the guide member 52 and is conveyed again to registration roller pair 22. Thereafter, similarly to the above-described process, the sheet S on which an image is formed on a second surface at the transfer nip 13 is discharged onto the discharge tray 55.

Peripheral Configuration of Upper Portion of Right Tray

Figure 3:
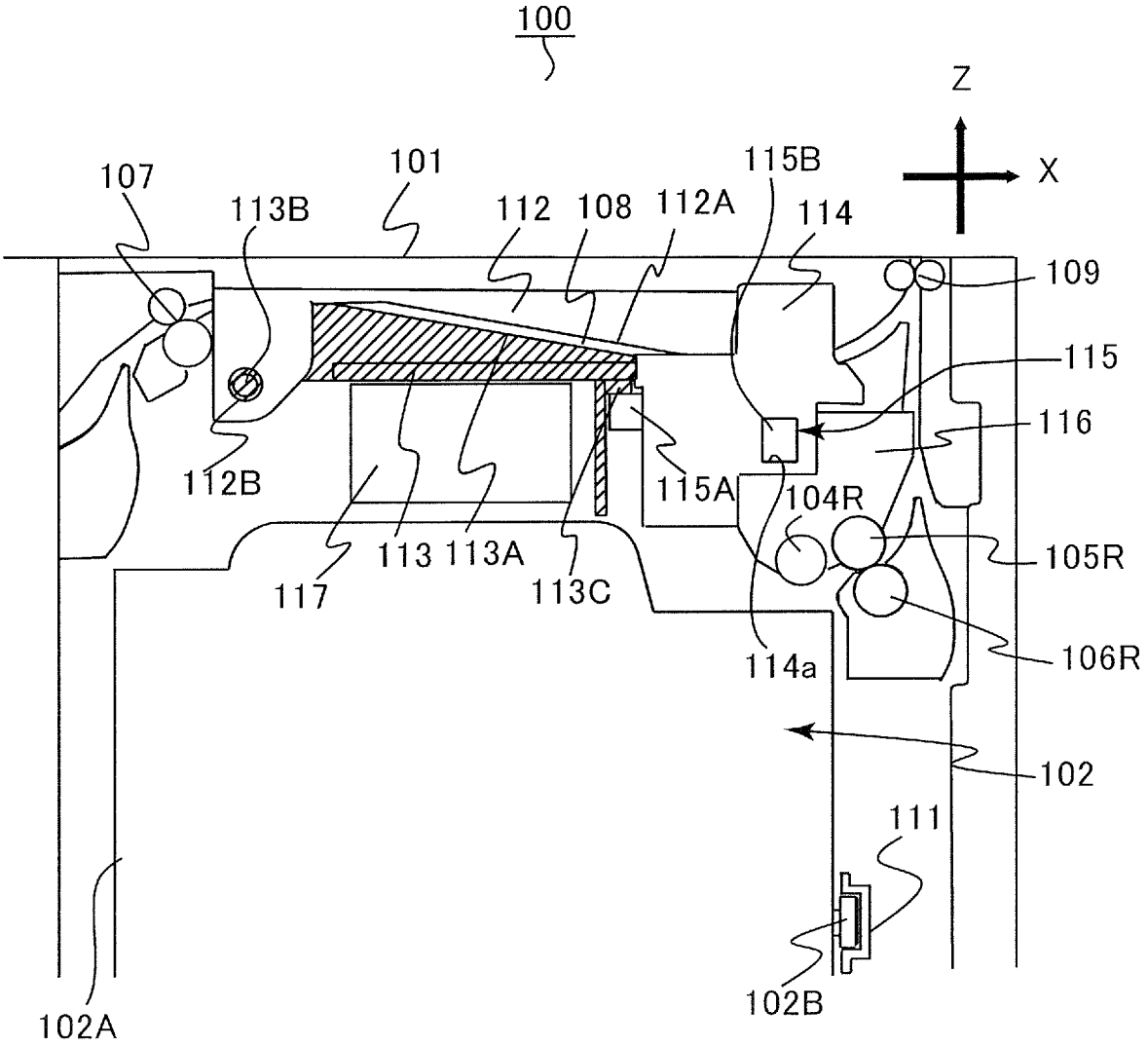
FIG. 3 is a section view showing the sheet feeding apparatus.

Next, the peripheral configuration of a drawer portion and an upper portion of the right tray 102 serving as a first drawer portion will be described. As shown in FIG. 3, the casing 101 that is an apparatus body is provided with a guide rail 111 extending in parallel with the insertion direction of the right tray 102, and the right tray 102 has a side roller 102B that rolls on the guide rail 111. When the side roller 102B rolls on the guide rail 111, the right tray 102 is smoothly guided in the mounting direction and the drawing-out direction. The right tray 102 is formed in a box shape with an open top.

The conveyance path 108 is disposed above the right tray 102, and the conveyance path 108 includes an upper guide 112 and a lower guide 113 serving as a pivot member. The upper guide 112 is fixed to the casing 101, and an upper guide surface 112A of the conveyance path 108 and a hole 112B extending in the axial direction parallel to the mounting direction (+Y direction) of the right tray 102 are formed in the upper guide 112. A lower guide surface 113A of the conveyance path 108 and a pivot shaft 113B extending in the axial direction parallel to the mounting direction (+Y direction) of the right tray 102 are formed in the lower guide 113.

The hole 112B and the pivot shaft 113B are respectively provided in front of and behind the conveyance path 108, and the pivot shaft 113B is rotatably supported by the hole 112B. As described above, the lower guide 113 is pivotable between a guide position (position shown in FIG. 5A) serving as a first position and a lower position (position shown in FIG. 5B) located below the guide position, serving as a second position, around the pivot shaft 113B. The lower guide 113 constitutes a part of the conveyance path 108 at the guide position. In addition, three rotation stoppers 113C arranged in parallel at a predetermined interval in the mounting direction (+Y direction) are provided at the distal end portion of the lower guide 113 (see FIG. 4).

An upper frame 114 and a feeding frame 116 are fixed to the casing 101, and the upper frame 114 holds a jam handling lever 115 so as to be movable. A hole 114*a* is formed in the upper frame 114 on the near side of the apparatus, that is, on the downstream side in the drawing-out direction (−Y direction), and the user can push a pushing portion 115B of the jam handling lever 115 in the mounting direction (+Y direction) through the hole 114*a*. The jam handling lever 115 is biased in the drawing-out direction by a compression spring (not shown).

The feeding frame 116 holds the pickup roller 104R, the feed roller 105R, and the separating roller 106R. The upper frame 114 and the feeding frame 116 respectively constitute a part of the conveyance path through which the sheet is conveyed. A drive unit 117 is provided on the far side of the casing 101 and between the lower guide 113 located at the guide position in the vertical direction and a rear wall 102A of the right tray 102. The drive unit 117 has a drive source such as a motor, and drives each roller of the sheet feeding apparatus 100.

Configuration for Opening Lower Guide

Figure 4A:
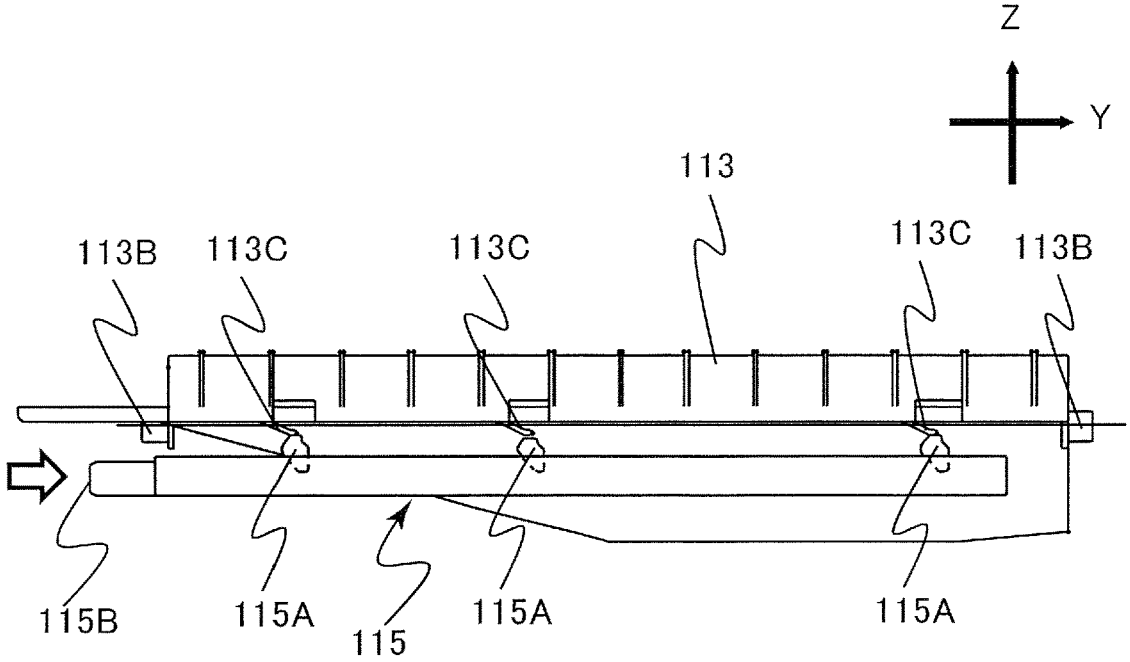
FIG. 4A is a left side view showing a peripheral configuration of a lower guide.

Next, a configuration for opening the lower guide 113 will be described. The lower guide 113 is opened, for example, in a condition in which a sheet is jammed in the conveyance path 108. As shown in FIG. 4A, in the jam handling lever 115, three guide holding units 115A arranged in parallel with a predetermined interval in the mounting direction (+Y direction) are provided at positions corresponding to three rotation stoppers 113C provided in the distal end portion of the lower guide 113.

Figure 4B:
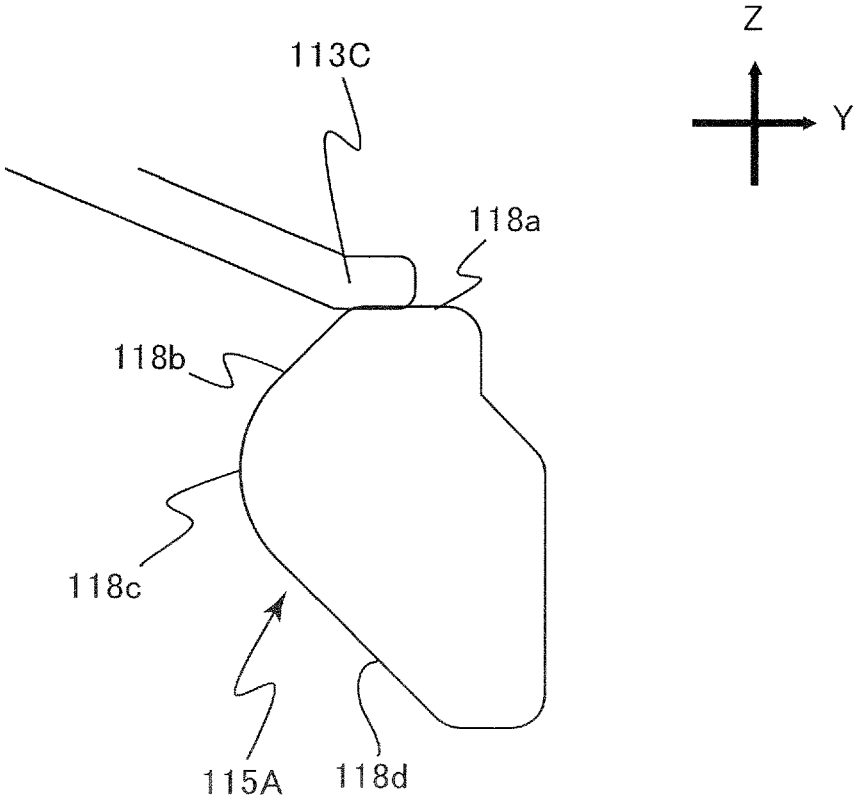
FIG. 4B is an enlarged view showing a rotation stopper and a guide holding unit.

As shown in FIG. 4B, the guide holding unit 115A serving as a holding member has a horizontal portion 118*a* extending horizontally and an upper cam surface 118*b* inclined downward from the horizontal portion 118*a* toward the front direction (−Y direction) as viewed from the right direction (+X direction). The guide holding unit 115A is disposed below the cam surface and the upper cam surface 118*b* that is a first cam surface, and has a lower cam surface 118*d* that is a second cam surface inclined downward in the rear direction (+Y direction). A tip portion 118*c* is formed between the upper cam surface 118*b* and the lower cam surface 118*d*.

Figure 5A:
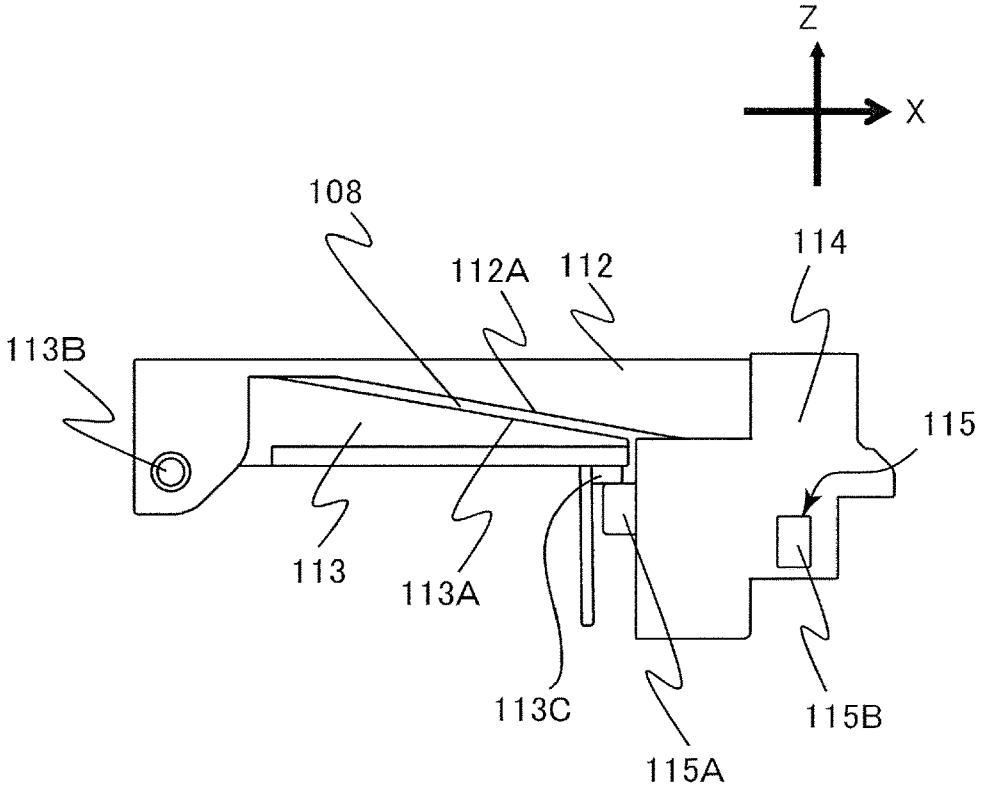
FIG. 5A is a front view showing a state where the lower guide is located at a guide position.

When the lower guide 113 is located at the guide position shown in FIG. 5A, the rotation stopper 113C of the lower guide 113 is in contact with the guide holding unit 115A. More specifically, as shown in FIG. 4B, the rotation stopper 113C is in contact with the horizontal portion 118*a* of the guide holding unit 115A by the weight of the rotation stopper 113C.

For example, when a jam occurs in the conveyance path 108 and the lower guide 113 is moved to the lower position, the user first draws the right tray 102 out of the casing 101. Then, the user pushes the pushing portion 115B of the jam handling lever 115 in the mounting direction (+Y direction). As a result, the jam handling lever 115 slidingly moves in the mounting direction, and the guide holding unit 115A provided on the jam handling lever 115 also slidingly moves in the mounting direction. Then, when the rotation stopper 113C of the lower guide 113 slides from the horizontal portion 118*a* of the guide holding unit 115A to the upper cam surface 118*b*, and is beyond the tip portion 118*c*, the engagement with the guide holding unit 115A is released.

Figure 5B:
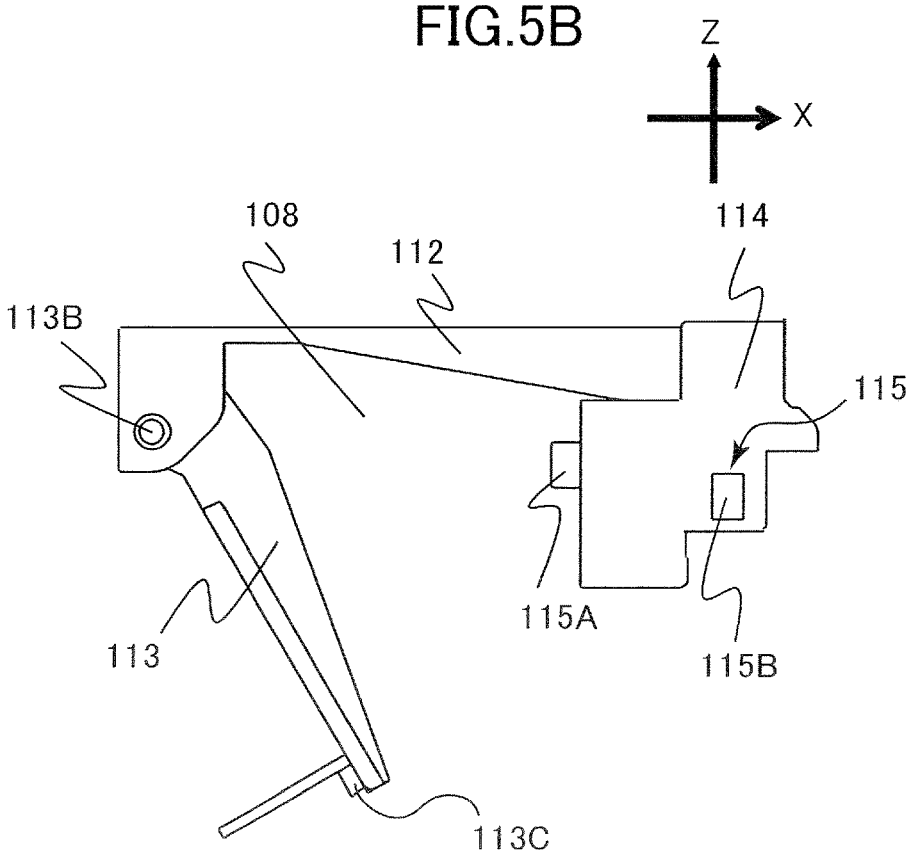
FIG. 5B is a front view showing a state where the lower guide is located at a lower position.

As a result, the lower guide 113 pivots downward by its own weight about the pivot shaft 113B, and is positioned at the lower position shown in FIG. 5B by a stopper (not illustrated). In the present embodiment, as shown in FIG. 5B, the lower guide 113 can widely open the conveyance path 108, and the jam handling capability is improved. A pivot angle between the guide position and the lower position of the lower guide 113 is set to about 60 degrees.

Figure 7A:
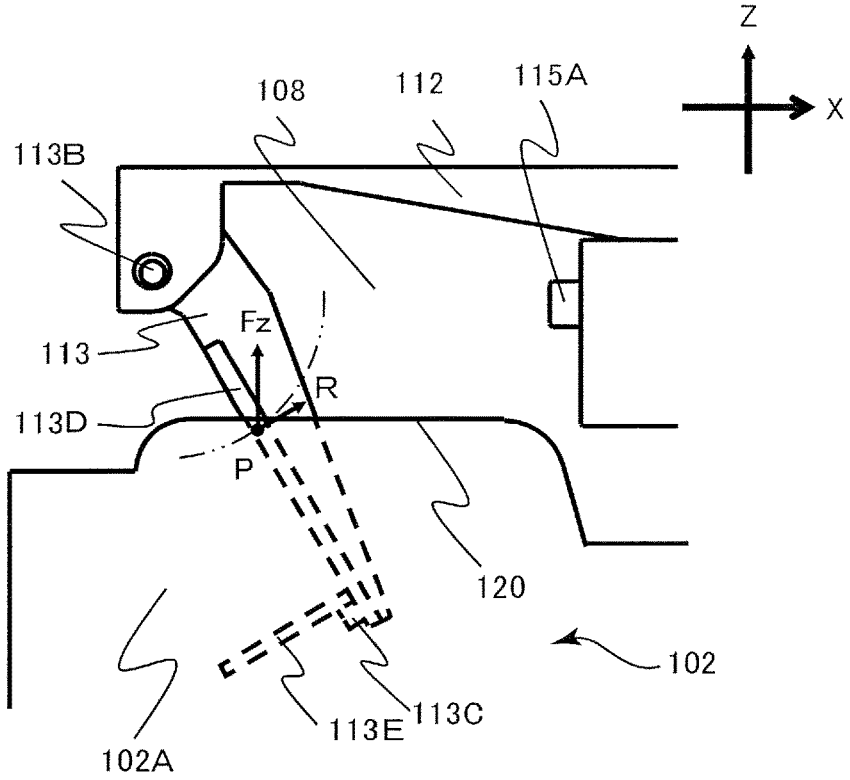
FIG. 7A is a front view showing a state where a first sliding contact surface and a lifting portion are in contact with each other.

Therefore, the lower guide 113 is configured to overlap the moving path of the right tray 102 when the lower guide 113 is located at the lower position as shown in FIG. 7A, and not to overlap the moving path of the right tray 102 when the lower guide 113 is located at the guide position as shown in FIG. 3.

Configuration for Lifting Lower Guide

Figure 6A:
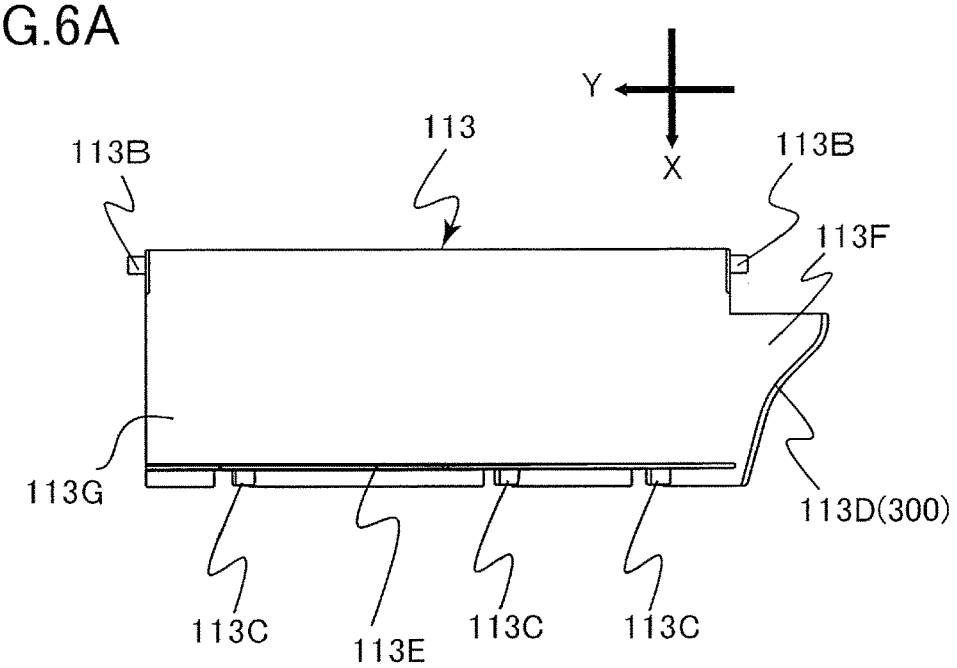
FIG. 6A is a bottom view showing the lower guide.

Next, a configuration for lifting the lower guide 113 will be described. FIG. 6A is a bottom view showing the lower guide 113, FIG. 6B is a left side view showing the lower guide 113, and FIG. 6C is a perspective view showing the lower guide 113.

Figure 6B:
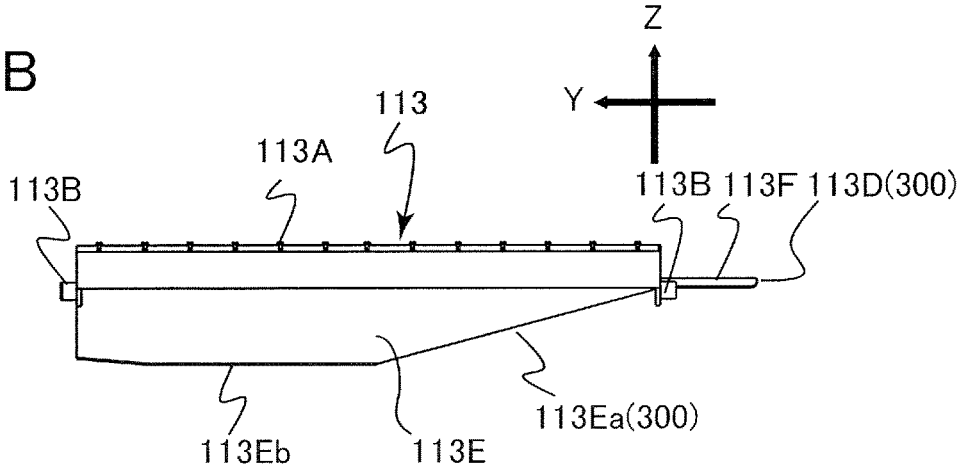
FIG. 6B is a left side view showing the lower guide.
Figure 6C:
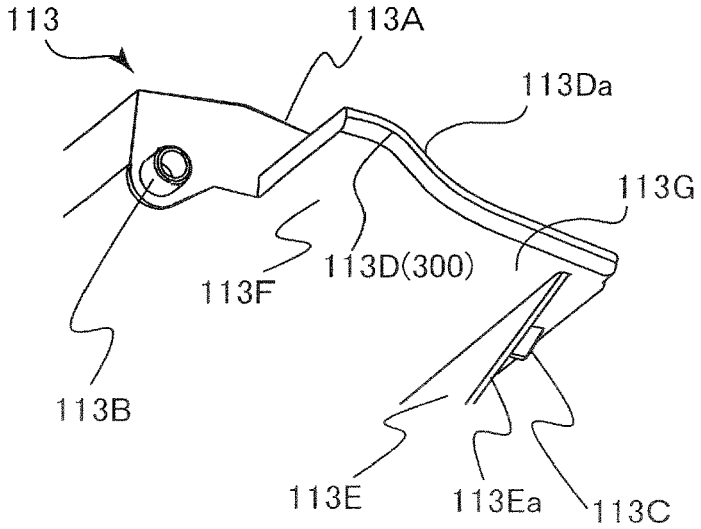
FIG. 6C is a perspective view showing the lower guide.

As shown in FIG. 6A to 6C, the lower guide 113 includes a handle portion 113F disposed upstream of the lower guide surface 113A in the mounting direction and a protruding portion 113E protruding from a surface 113G opposite to the lower guide surface 113A. A first sliding contact surface 113D is formed on an upstream edge surface of the handle portion 113F in the mounting direction, and a second sliding contact surface 113Ea and a straight portion 113Eb are formed on a lower edge surface of the protruding portion 113E. The first sliding contact surface 113D and the second sliding contact surface 113Ea constitute a second contact portion 300, and are in slidable contact with a lifting portion 120 (see FIG. 7A) formed on the rear wall 102A of the right tray 102. That is, the first sliding contact surface 113D and the second sliding contact surface 113Ea are provided so as to face the rear wall 102A of the right tray 102 which is to be mounted on the casing 101.

The first sliding contact surface 113D has an R-shaped portion 113Da formed so as to extend downstream in the mounting direction (+Y direction) as the first sliding contact surface 113D goes outward in a radial direction orthogonal to the axial direction of the pivot shaft 113B. By inserting the right tray 102 when the lower guide 113 is located at the lower position, the lifting portion 120 of the right tray 102 comes into contact with the R-shaped portion 113Da.

The protruding portion 113E has a rib shape drawing in the mounting direction (+Y direction), and the second sliding contact surface 113Ea is inclined downward as the second sliding contact surface 113Ea goes downstream in the mounting direction. The straight portion 113Eb extends in the mounting direction while maintaining a certain height from the downstream end of the second sliding contact surface 113Ea in the mounting direction.

Figure 7B:
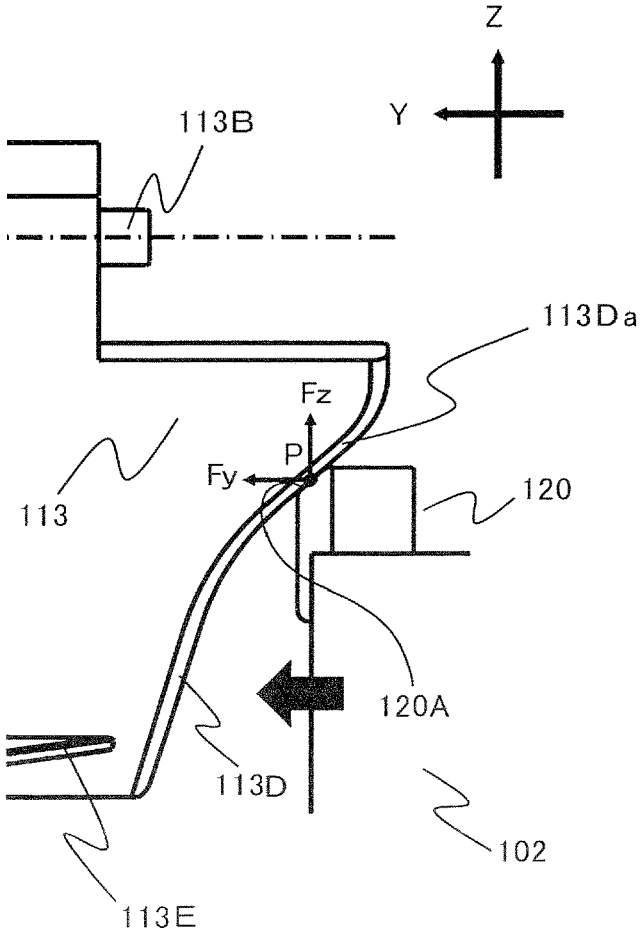
FIG. 7B is an enlarged view showing a contact point between the first sliding contact surface and the lifting portion.

As shown in FIG. 7A, the lifting portion 120 serving as the first contact portion is formed at the upper end of the rear wall 102A provided on the downstream side of the right tray 102 in the mounting direction, and extends in the right-left direction (±X direction) which is horizontal direction orthogonal to the mounting direction. As shown in FIG. 7B, a tapered surface 120A is formed at the upper end of the lifting portion 120 and the downstream end in the mounting direction, and the tapered surface 120A is inclined downward as the tapered surface 120A goes downstream in the mounting direction. The tapered surface 120A is formed to be long in the right-left direction at the upper portion of the lifting portion 120, and smoothly comes into sliding contact with the first sliding contact surface 113D and the second sliding contact surface 113Ea of the lower guide 113.

Next, an operation of lifting the lower guide 113 from the lower position toward the guide position when the right tray 102 is mounted on the casing 101 will be described. When the lower guide 113 is located at the lower position, the moving path in the mounting operation of the right tray 102 and the lower guide 113 overlap in the vertical direction (±Z direction). Dot-lines in FIG. 7A indicates a portion where the lower guide 113 overlaps the moving path.

In a case where the right tray 102 is inserted when the lower guide 113 is located at the lower position, as shown in FIGS. 7A and 7B, the first sliding contact surface 113D of the lower guide 113 comes into contact with the lifting portion 120 of the right tray 102. More specifically, the R-shaped portion 113Da of the lower guide 113 comes into contact with the tapered surface 120A of the lifting portion 120. A contact point P is a position where the first sliding contact surface 113D and the second sliding contact surface 113Ea and the lifting portion 120 are in contact. The contact point P moves on the first sliding contact surface 113D and the second sliding contact surface 113Ea as the lower guide 113 is lifted.

At the contact point P in FIGS. 7A and 7B, a force Fy downstream in the mounting direction (+Y direction) and a force Fz upward (+Z direction) are exerted on the lower guide 113, from the lifting portion 120 to be inserted. Since the force Fy is parallel to the axial direction of the pivot shaft 113B, the force Fy is not involved in the force for pivoting the lower guide 113. As shown in FIG. 7A, the force Fz becomes a force R for rotating the lower guide 113, and the lower guide 113 is pivoted from the lower position toward the guide position by the force R.

Figure 8A:
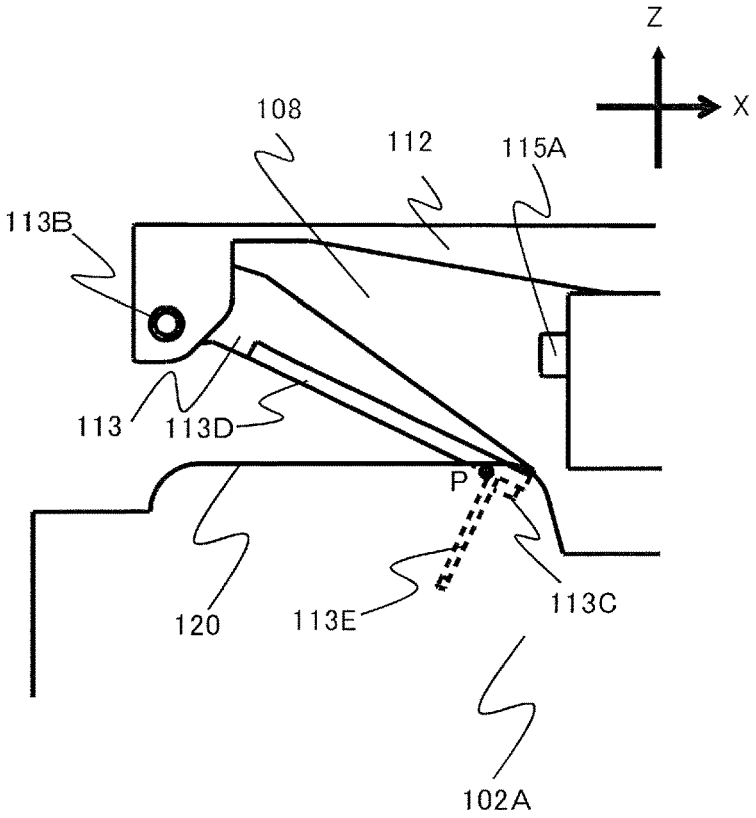
FIG. 8A is a front view showing a state where the lifting portion is in sliding contact with the first sliding contact surface.
Figure 8B:
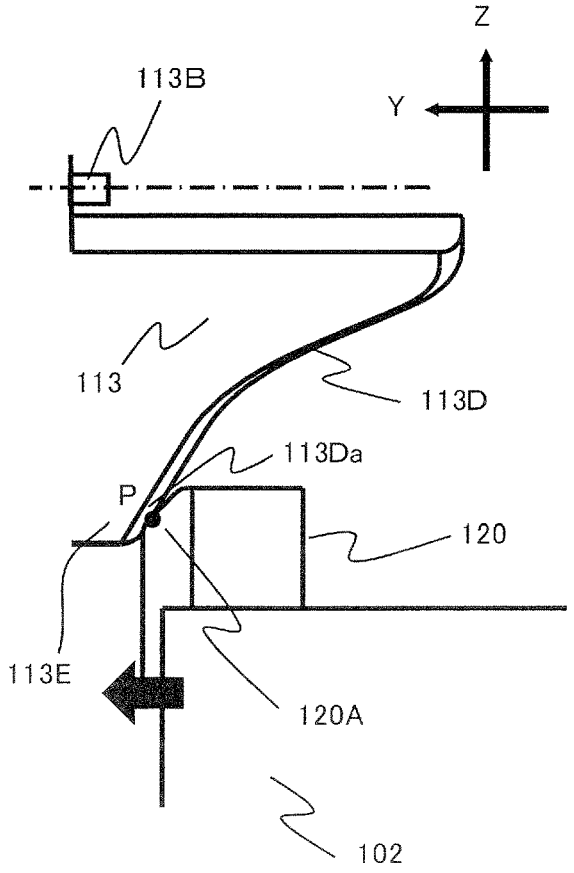
FIG. 8B is an enlarged view showing a contact point between the first sliding contact surface and the lifting portion.

When the right tray 102 is further inserted in the insertion direction (+Y direction), as shown in FIG. 8A, the lower guide 113 pivots counterclockwise so as to be lifted. As a result, the amount of overlap between the lower guide 113 and the moving path of the right tray 102 decreases. The contact point P moves from the left direction to the right direction on the tapered surface 120A of the lifting portion 120. As shown in FIG. 8B, the contact point P moves on the first sliding contact surface 113D outward in the radial direction orthogonal to the axial direction of the pivot shaft 113B and toward the downstream in the mounting direction (+Y direction). Further, when the right tray 102 is inserted, the sliding contact between the lifting portion 120 and the first sliding contact surface 113D is completed, and then the lifting portion 120 is continuously in sliding contact with the second sliding contact surface 113Ea. The first sliding contact surface 113D has a curved surface shape so that an excessive load is not applied to the lower guide 113 in the process in which the lower guide 113 is lifted.

Figure 9A:
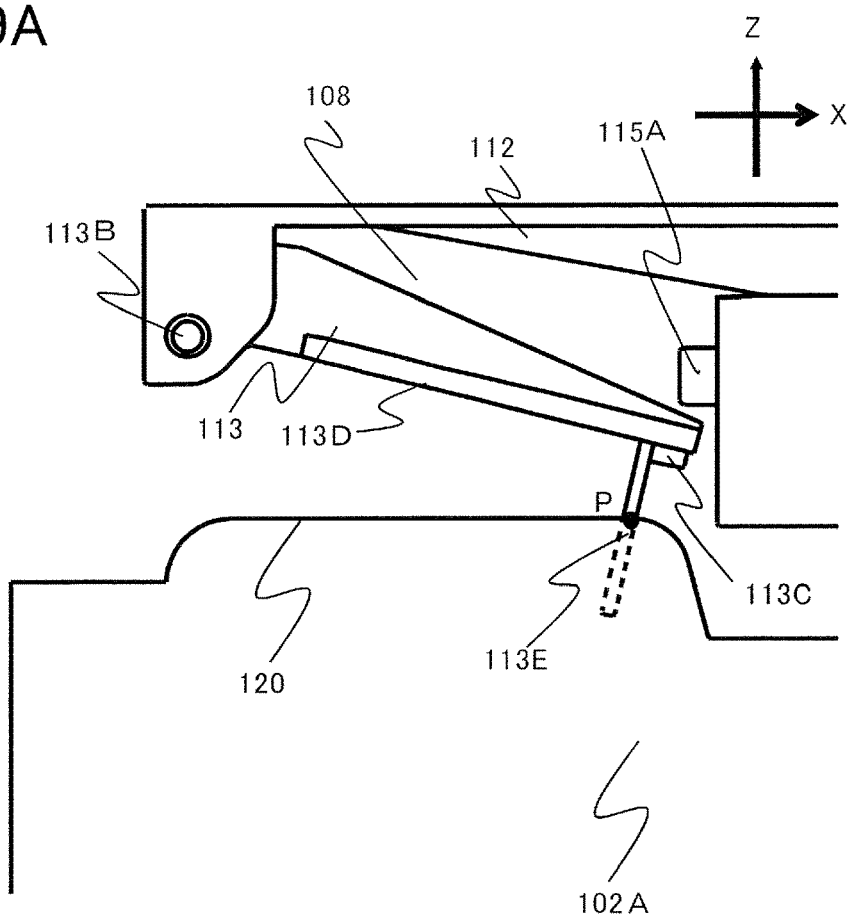
FIG. 9A is a front view showing a state where the lifting portion is in sliding contact with a second sliding contact surface.
Figure 9B:
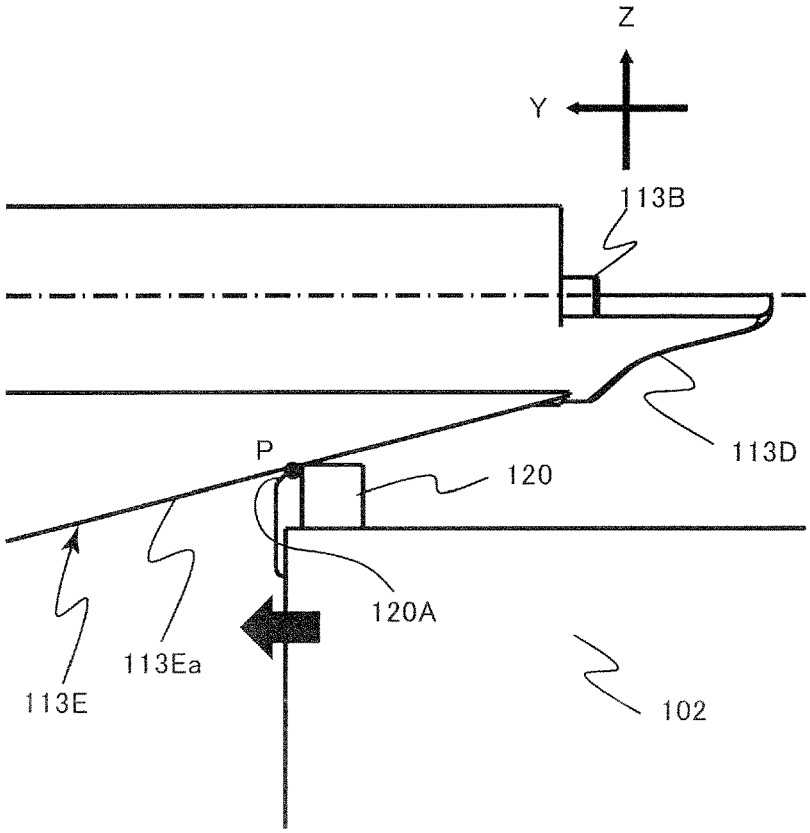
FIG. 9B is a left side view showing a contact point between the second sliding contact surface and the lifting portion.

When the right tray 102 is further inserted in the insertion direction (+Y direction), as shown in FIGS. 9A and 9B, the lifting portion 120 comes into sliding contact with the second sliding contact surface 113Ea. Since the second sliding contact surface 113Ea is inclined downward toward the downstream in the mounting direction, the lower guide 113 is lifted toward the guide position as the right tray 102 is inserted. At this time, the contact point P slightly moves from the left direction to the right direction on the tapered surface 120A of the lifting portion 120. The contact point P moves on the second sliding contact surface 113Ea toward the downstream in the mounting direction (+Y direction).

Figure 10A:
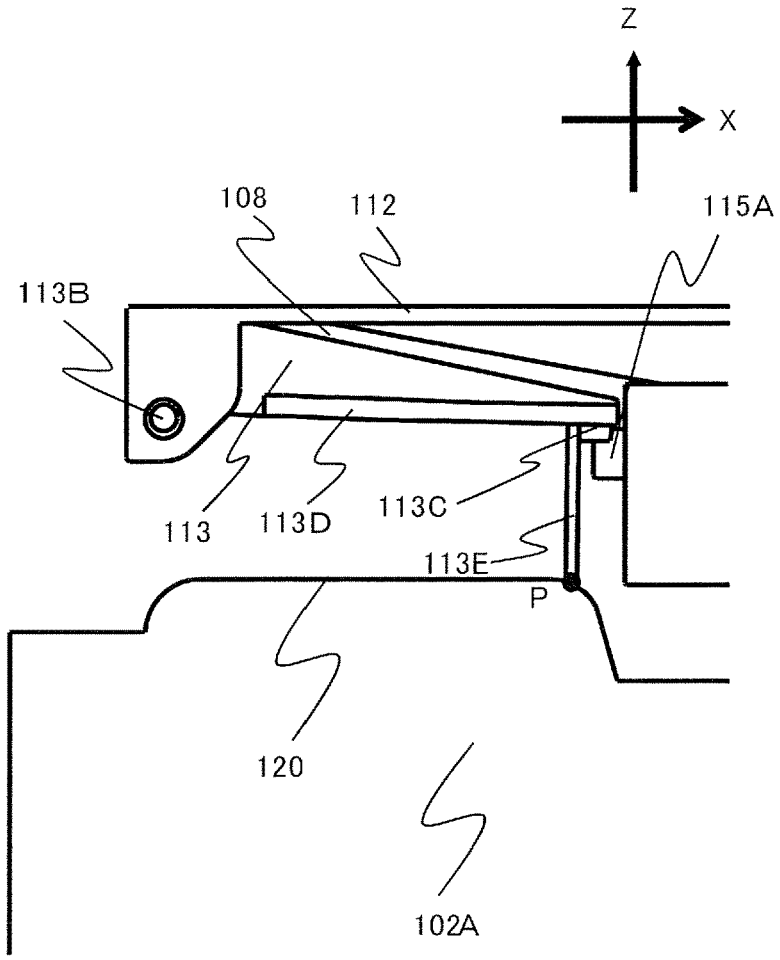
FIG. 10A is a front view showing a state where the lifting portion reaches an end of the second sliding contact surface.
Figure 10B:
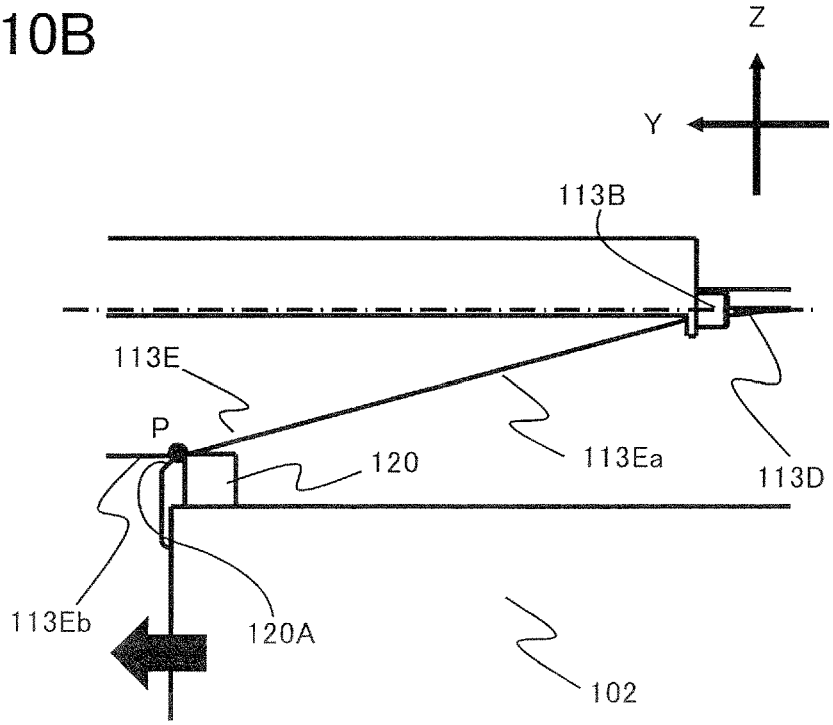
FIG. 10B is a left side view showing a contact point between the second sliding contact surface and the lifting portion.

FIGS. 10A and 10B are diagrams showing a state where the contact point P has reached the vicinity of an inflection point between the second sliding contact surface 113Ea and the straight portion 113Eb, where FIG. 10A is a front view and FIG. 10B is a left side view. When the right tray 102 is inserted into the casing 101 and the contact point P between the second sliding contact surface 113Ea and the lifting portion 120 reaches the vicinity of the inflection point, the rotation stopper 113C of the lower guide 113 comes into contact with the guide holding unit 115A.

Figure 11A:
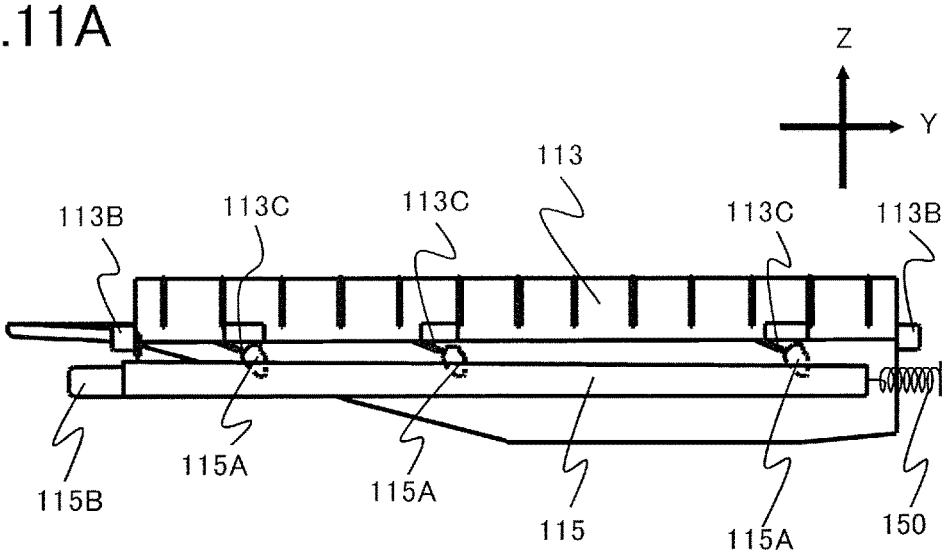
FIG. 11A is a left side view showing a peripheral configuration of the lower guide.
Figure 11B:
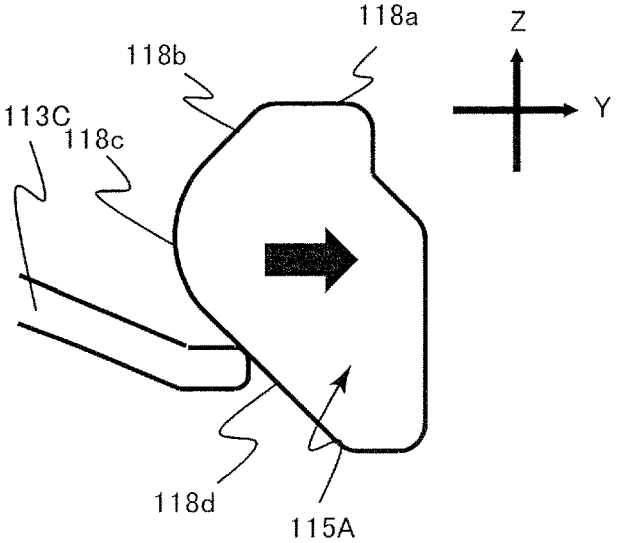
FIG. 11B is an enlarged view showing a state where the rotation stopper and a lower cam surface of the guide holding unit are in contact with each other.

Hereinafter, the contact relationship between the rotation stopper 113C and the guide holding unit 115A will be described more specifically. As shown in FIGS. 11A and 11B, when the contact point P is located immediately before the inflection point between the second sliding contact surface 113Ea and the straight portion 113Eb, the rotation stopper 113C comes into contact with the lower cam surface 118*d* of the guide holding unit 115A. The jam handling lever 115 having the guide holding unit 115A is biased by a compression spring 150 in the drawing-out direction (−Y direction) serving as a first movement direction, and is positioned by a stopper (not illustrated). Instead of the compression spring 150, a tension spring or other biasing members may be provided.

Figure 11C:
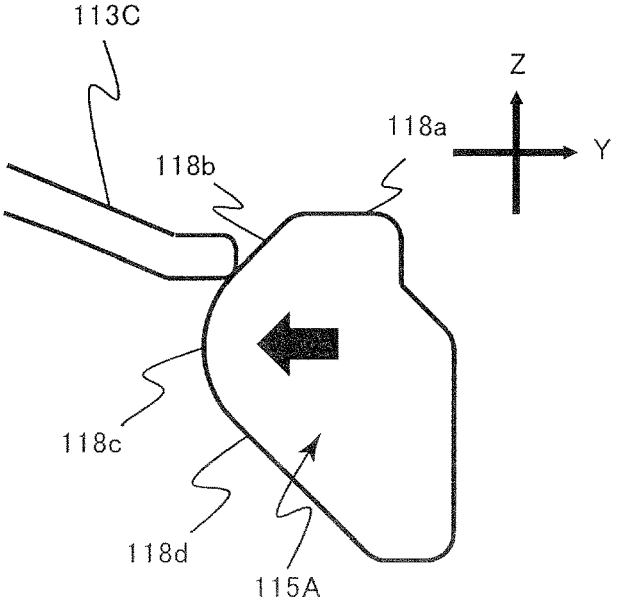
FIG. 11C is an enlarged view showing a state where the rotation stopper and an upper cam surface of the guide holding unit are in contact with each other.

When the lower guide 113 is lifted by inserting the right tray 102, the rotation stopper 113C presses the jam handling lever 115 in the mounting direction (+Y direction) serving as a second movement direction against the biasing force of the compression spring while being in sliding contact with the lower cam surface 118*d*. As a result, the jam handling lever 115 having the guide holding unit 115A moves in the mounting direction (+Y direction). When the rotation stopper 113C passes the tip portion 118*c*, as shown in FIG. 11C, the guide holding unit 115A is moved in the drawing-out direction (−Y direction) by the biasing force of the compression spring, and the rotation stopper 113C is lifted along the upper cam surface 118*b*. That is, when the lower guide 113 that pivots toward the guide position passes through the tip portion 118*c*, the jam handling lever 115 switches the movement direction from the mounting direction (+Y direction) to the drawing-out direction (−Y direction).

Accordingly, the lower guide 113 having the rotation stopper 113C is finally lifted up to the horizontal portion 118*a* by the force of the compression spring and reaches the guide position. The lower guide 113 moves away from the lifting portion 120 of the right tray 102 when being pivoted toward the guide position by being pressed by the upper cam surface 118*b*. Accordingly, the lower guide 113 has the second contact portion 300 that pivots the lower guide 113 from the lower position toward the guide position while being in sliding contact with the lifting portion 120 when the lower guide 113 is located at the lower position, and when the right tray 102 is being inserted into the casing 101.

When the rotation stopper 113C is supported by the upper cam surface 118*b* beyond the tip portion 118*c*, the position of the inflection point is set so that the contact point P reaches the inflection point between the second sliding contact surface 113Ea and the straight portion 113Eb.

As described above, since the lower guide 113 is lifted by the compression spring when the rotation stopper 113C reaches the upper cam surface 118*b*, the lifting portion 120 does not come into contact with the straight portion 113Eb. Then, the straight portion 113Eb moves away from the lifting portion 120 by the distance that the lower guide 113 is lifted by the compression spring. Therefore, thereafter, until the right tray 102 is inserted to the mounting position where the sheet S can be fed, the straight portion 113Eb and the lifting portion 120 are separated from each other while maintaining the above-mentioned distance and do not interfere with each other.

As described above, in the present embodiment, since the lower guide 113 is configured to be widely opened, the visibility and workability at the time of jam handling are good, and thus the jam handling capability can be improved. Since the lower guide 113 located at the lower position overlaps the moving path of the right tray 102, the apparatus can be downsized in the height direction.

Further, when the right tray 102 is inserted even in the state where the lower guide 113 is located at the lower position, the lifting portion 120 of the right tray 102 is in sliding contact with the first sliding contact surface 113D and the second sliding contact surface 113Ea of the lower guide 113, and can be pivoted toward the guide position. The lower guide 113 returns to the guide position by the action of the guide holding unit 115A.

Therefore, even when the user does not manually pivot the lower guide 113, the lower guide 113 can be returned to the guide position without breaking the lower guide 113 and the right tray 102, and usability can be improved. It is noted that the lower guide 113 can also be manually returned to the guide position by lifting the handle portion 113F.

The lifting portion 120 is formed on the rear wall 102A of the right tray 102, and is formed thin in the mounting direction (+Y direction). Due to the shape of the first sliding contact surface 113D, the contact point P moves from the left side to the right side on the lifting portion 120 as the right tray 102 is inserted. Therefore, the apparatus can be downsized without forming the lifting portion 120 to be long in the mounting direction.

In addition, since the second sliding contact surface 113Ea is inclined downward toward the downstream in the mounting direction, it is not necessary to form the lifting portion 120 high in the height direction (+Z direction). When the lifting portion 120 is formed high, the sheet feeding apparatus 100 may be increased in size in the height direction so that the drive unit 117 and the lifting portion 120 disposed on the far side of the casing 101 do not interfere with each other. In the present embodiment, since the protruding portion 113E having the second sliding contact surface 113Ea and the straight portion 113Eb is formed on the distal end side of the lower guide 113 having a sufficient space, the apparatus can be downsized.

Second Embodiment

Next, a second embodiment of the present invention will be described; however, the second embodiment is obtained by changing the shape of the lifting portion in the first embodiment. Therefore, about the configuration similar to the first embodiment, the illustration is omitted or the same reference numerals are denoted to the drawings for description.

As shown in FIG. 12, a sheet feeding apparatus 100B has a right tray 102 that can be mounted on and drawn out from the casing 101 (see FIG. 2) and a lower guide 131 serving as a pivot member that forms the conveyance path 108 (see FIG. 1). The lower guide 131 is pivotable about a pivot shaft 113B extending in an axial direction parallel to the mounting direction (+Y direction), and has the same configuration as the lower guide 113 of the first embodiment except that there is no protruding portion 113E.

A lifting portion 130 serving as a first contact portion is formed on the upper portion of a rear wall 102A of the right tray 102. The lifting portion 130 is formed thin in the mounting direction (+Y direction). The lifting portion 130 is inclined upward from the left side which is one side to the right side which is the other side in the horizontal direction (±X direction) orthogonal to the mounting direction (+Y direction).

Figure 12A:
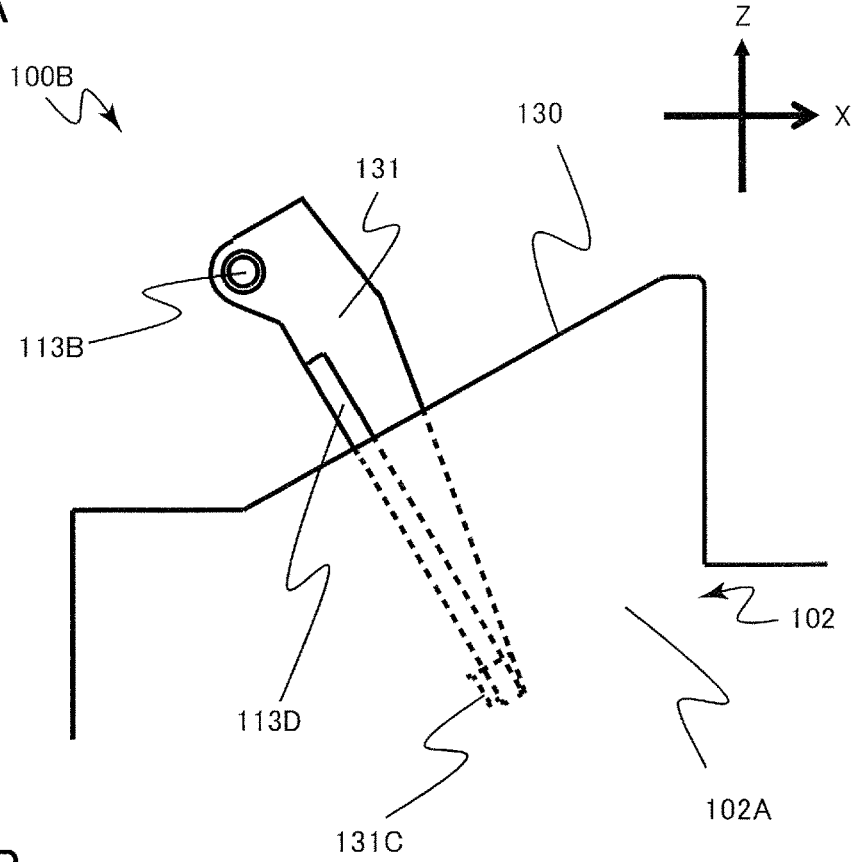
FIG. 12A is a front view showing a state where a first sliding contact surface and a lifting portion are in contact with each other, according to a second embodiment.

In a case where the right tray 102 is inserted when the lower guide 131 is located at the lower position, as shown in FIG. 12A, the lifting portion 130 comes into contact with a first sliding contact surface 113D serving as a second contact portion. As described in the first embodiment, as the right tray 102 is inserted, the lower guide 131 is lifted toward the guide position by the lifting portion 130. At this time, a contact point between the lifting portion 130 and the first sliding contact surface 113D moves from the left side to the right side.

Figure 12B:
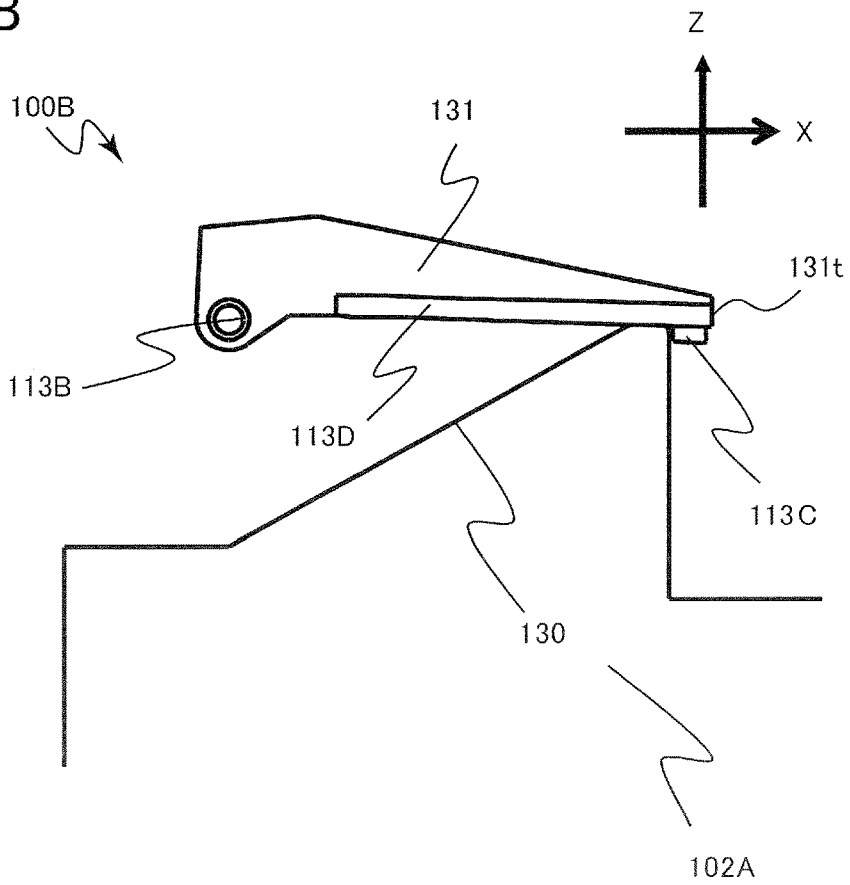
FIG. 12B is a front view showing a state where a lower guide is lifted by the lifting portion.

As shown in FIG. 12B, when the lower guide 131 reaches a position where it does not overlap the right tray 102 in the vertical direction, the lower guide 131 is lifted to the guide position by the guide holding unit 115A (see FIG. 10A) as in the first embodiment. A distal end 131*t* of the lower guide 131 in the radial direction is located on the right side in the horizontal direction with respect to the pivot shaft 113B when the lower guide 131 is located at the guide position.

As described above, when the protruding portion 113E described in the first embodiment cannot be provided on the lower guide 131 side due to the space in the mounting direction (+Y direction), the lower guide 113 can be returned to the guide position by inclining the lifting portion 130. Thereby, usability can be improved.

In any of the above-described embodiments, the pivot angle between the guide position and the lower position of the lower guide 113 is set to about 60 degrees, but is not limited thereto. In the first embodiment, the lifting portion 120 extends in the right-left direction, which is the horizontal direction. However, the lifting portion 120 may extend with an inclination in a range of ±20 degrees with respect to the horizontal direction.

In any of the above-described embodiments, the guide holding unit 115A lifts the lower guide to the guide position by moving in the drawing-out direction, but is not limited thereto. That is, the jam handling lever 115 having the guide holding unit 115A may be configured to be movable in any direction, and may be configured to be movable in a direction orthogonal to the mounting direction and the vertical direction, for example. In addition, for example, the jam handling lever 115 having the guide holding unit 115A may be biased by the compression spring 150 in the mounting direction instead of the drawing-out direction. In this case, the guide holding unit 115A is configured to lift the lower guide to the guide position by moving in the drawing-out direction. The guide holding unit 115A may be configured such that the engagement with the rotation stopper 113C can be released by being pushed in either the mounting direction or the drawing-out direction.

In any of the above-described embodiments, the present invention is applied to the sheet feeding apparatus having the left tray 103 and the right tray 102, but is not limited to thereto. For example, sheet feeding apparatuses having only one tray corresponding to the A3 size are arranged side by side below the printer body 200, and the present invention may be applied to one sheet feeding apparatus. In addition, the present invention may be applied so that, in the printer body 200, for example, the duplex conveyance path 57 is disposed above the cassette 15 and the duplex conveyance path 57 is returned to the guide position by inserting the cassette 15.

In any of the above-described embodiments, the electrophotographic printer 1 has been described, but the present invention is not limited thereto. For example, the present invention can be applied to an inkjet image forming apparatus that forms an image on a sheet by ejecting ink liquid from a nozzle.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-232988, filed Dec. 12, 2018, which is hereby incorporated by reference herein in its entirety.

What is claimed is:

1. A sheet feeding apparatus comprising:

an apparatus body comprising a conveyance path through which a sheet passes;

a drawer portion provided to be mounted on and drawn out from the apparatus body and configured to support the sheet, the drawer portion comprising a first contact portion;

a feeding portion configured to feed the sheet supported on the drawer portion; and a pivot member configured to pivot between a first position and a second position located below the first position around a pivot shaft extending in an axial direction parallel to a mounting direction of the drawer portion, the pivot member constituting a part of the conveyance path at the first position, wherein the pivot member does not overlap a moving path of the drawer portion in a case where the pivot member is located at the first position, and overlaps the moving path in a case where the pivot member is located at the second position, and the pivot member comprises a second contact portion that pivots the pivot member from the second position toward the first position while being in sliding contact with the first contact portion in a case where the pivot member is located at the second position and the drawer portion is being inserted into the apparatus body.

2. The sheet feeding apparatus according to claim 1, wherein the first contact portion is provided on a downstream side of the drawer portion in the mounting direction, the second contact portion comprises a first sliding contact surface which is in slidable contact with the first contact portion and which is provided on an upstream side of the pivot member in the mounting direction, and the first sliding contact surface extends downstream in the mounting direction as the first sliding contact surface goes outward in a radial direction orthogonal to the axial direction.

3. The sheet feeding apparatus according to claim 2, wherein the drawer portion is formed in a box shape with an open top, the first contact portion is provided on an upper end of a rear wall of the drawer portion, and the first sliding contact surface is provided to face the rear wall of the drawer portion which is to be mounted on the apparatus body.

4. The sheet feeding apparatus according to claim 2, wherein the first sliding contact surface has a curved surface shape.

5. The sheet feeding apparatus according to claim 2, wherein the second contact portion comprises a second sliding contact surface which is disposed downstream of the first sliding contact surface in the mounting direction and which is in slidable contact with the first contact portion.

6. The sheet feeding apparatus according to claim 5, wherein the first contact portion extends in a horizontal direction orthogonal to the mounting direction, and the second sliding contact surface is inclined downward as the second sliding contact surface goes downstream in the mounting direction in a case where the pivot member is located at the first position.

7. The sheet feeding apparatus according to claim 2, wherein the first contact portion is inclined upward from one side to the other side in a horizontal direction orthogonal to the mounting direction.

8. The sheet feeding apparatus according to claim 1, further comprising a holding member configured to hold the pivot member at the second position.

9. The sheet feeding apparatus according to claim 8, wherein the holding member holds the pivot member at the second position in a state where the pivot member is separated from the drawer portion.

10. The sheet feeding apparatus according to claim 8, wherein the holding member is movable in a first movement direction and a second movement direction opposite to the first movement direction and comprises a cam surface that pivots the pivot member to the second position in a case where the holding member moves in the first movement direction.

11. The sheet feeding apparatus according to claim 10, wherein the holding member releases holding of the pivot member by moving in the second movement direction.

12. The sheet feeding apparatus according to claim 11, wherein the cam surface is a first cam surface inclined downward in the first movement direction, and the holding member comprises a second cam surface inclined downward in the second movement direction.

13. The sheet feeding apparatus according to claim 12, further comprising a biasing member configured to bias the holding member in the first movement direction, wherein the holding member moves in the second movement direction against a biasing force of the biasing member by the second cam surface being pressed by the pivot member, and the pivot member is pivoted toward the second position by being pressed against the first cam surface of the holding member that moves in the first movement direction by the biasing force of the biasing member.

14. The sheet feeding apparatus according to claim 13, wherein the holding member comprises a tip portion provided between the first cam surface and the second cam surface, and switches movement directions from the first movement direction to the second movement direction in a case where the pivot member that pivots toward the second position passes through the tip portion.

15. The sheet feeding apparatus according to claim 13, wherein the second contact portion of the pivot member moves away from the first contact portion of the drawer portion in a case where the pivot member pivots toward the second position by being pressed against the first cam surface of the holding member.

16. The sheet feeding apparatus according to claim 10, wherein the first movement direction is one of the mounting direction and a drawing-out direction opposite to the mounting direction.

17. The sheet feeding apparatus according to claim 1, wherein the pivot member guides the sheet in a horizontal direction orthogonal to the mounting direction in a case where the pivot member is located at the first position.

18. The sheet feeding apparatus according to claim 1, wherein the drawer portion is a first drawer portion, the sheet feeding apparatus further comprises a second drawer portion that is adjacent to the first drawer portion, is provided to be mounted on and drawn out from the apparatus body, and is configured to support the sheet, and the pivot member guides the sheet fed from the second drawer portion in a case where the pivot member is located at the first position.

19. An image forming apparatus comprising:

the sheet feeding apparatus according to claim 1; and an image forming portion configured to form an image on a sheet fed from the sheet feeding apparatus.

* * * * *